United States Patent [19]

Duncan

[11] 4,234,408

[45] Nov. 18, 1980

[54] PROCESS FOR HYDROCRACKING CARBONACEOUS MATERIAL IN LIQUID CARRIER

[75] Inventor: Dennis A. Duncan, Downers Grove, Ill.

[73] Assignee: The United States of America as represented by the United States Department of Energy, Washington, D.C.

[21] Appl. No.: 29,963

[22] Filed: Apr. 13, 1979

[51] Int. Cl.[3] ..... A45C 11/02; B65D 85/18

[52] U.S. Cl. ..... 208/8 R; 208/8 LE

[58] Field of Search ..... 208/8 R, 8 LE

[56] References Cited

U.S. PATENT DOCUMENTS 3,817,723 6/1974 Donath ..... 208/8 R

OTHER PUBLICATIONS

Duncan et al., "R & D of Rapid Hydrogenation for Coal Conversion to Synthetic Motor Fuels," Task 1, USDOE-IGT, 1976.

ERDA-76-86, "Coal Conversion and Utilization, Solvent-Refined Coal (SRC) Process," pp. 2.7-2.13, USERDA, 1976.

"Hydrocarbon Processing," Olefins Production by Gas Oil Cracking, pp. 161-166.

*Primary Examiner*—Paul F. Shaver

*Attorney, Agent, or Firm*—James E. Denny; Frank H. Jackson; Hugh W. Glenn

[57] ABSTRACT

Solid carbonaceous material is hydrocracked to provide aliphatic and aromatic hydrocarbons for use as gaseous and liquid fuels or chemical feed stock. Particulate carbonaceous material such as coal in slurry with recycled product oil is preheated in liquid state to a temperature of 600°-1200° F. in the presence of hydrogen gas. The product oil acts as a sorbing agent for the agglomerating bitumins to minimize caking within the process. In the hydrocracking reactor, the slurry of oil and carbonaceous particles is heated within a tubular passageway to vaporize the oil and form a gas-solid mixture which is further heated to a hydropyrolysis temperature in excess of 1200° F. The gas-solid mixture is quenched by contact with additional oil to condense normally liquid hydrocarbons for separation from the gases. A fraction of the hydrocarbon liquid product is recycled for quenching and slurrying with the carbonaceous feed. Hydrogen is recovered from the gas for recycle and additional hydrogen is produced by gasification of residual char.

7 Claims, 1 Drawing Figure

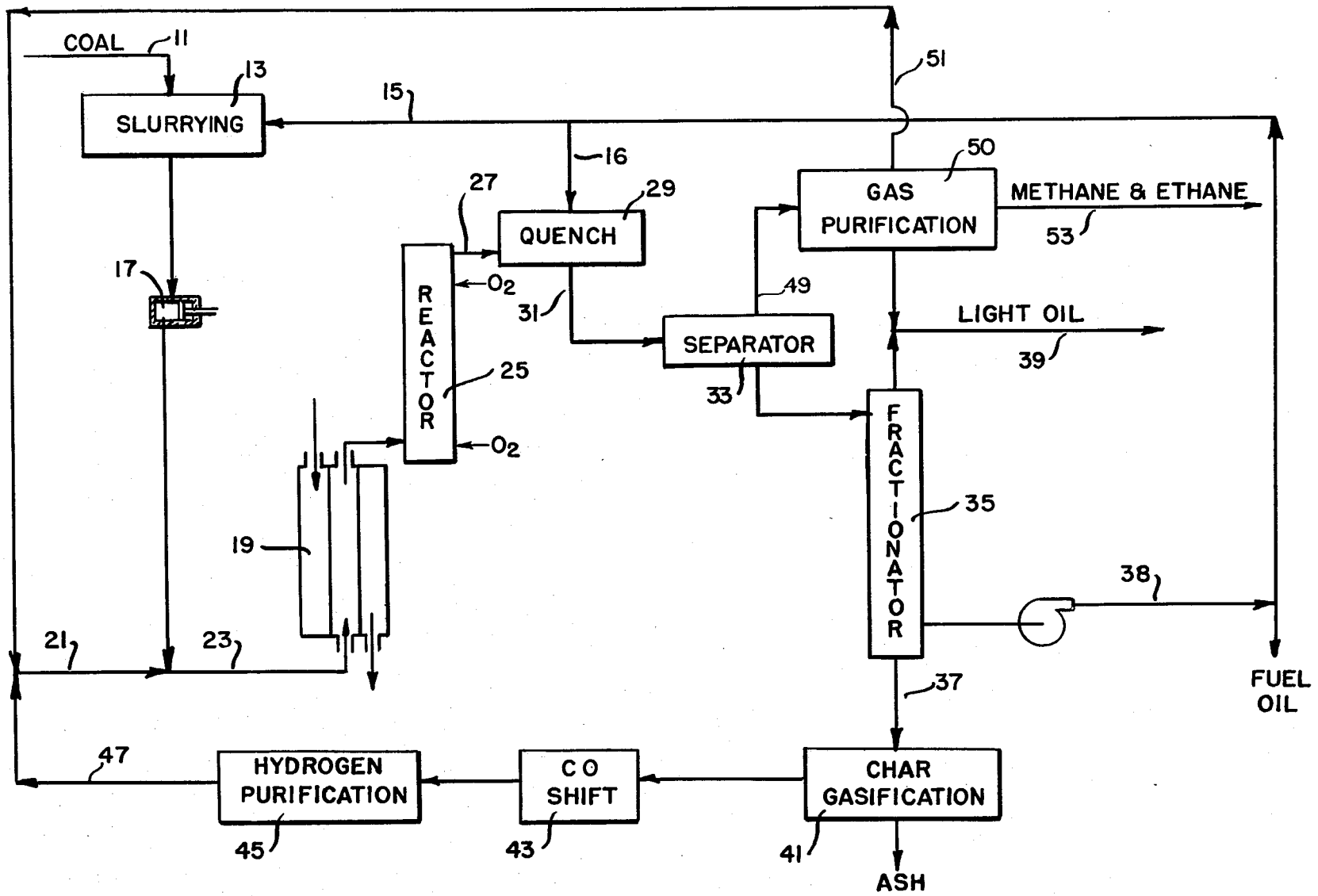
FUEL OIL
METHANE & ETHANE
53
38
LIGHT OIL
39
50
GAS PURIFICATION
35
FRACTIONATOR
37
CHAR GASIFICATION
ASH
51
49
SEPARATOR
33
41
29
QUENCH
16
31
CO SHIFT
43
27
O2
25
O2
REACTOR
15
HYDROGEN PURIFICATION
45
13
SLURRYING
19
23
11
COAL
17
21
47

PROCESS FOR HYDROCRACKING CARBONACEOUS MATERIAL IN LIQUID CARRIER

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention relates to a process for hydrocracking coal and other carbonaceous materials. The materials contemplated include anthracite, bituminous and lignite coal, as well as peat, oil shale, tar sand, wood, lignin, solid petroleum residuals and other related materials. The development is particularly applicable to the conversion of lignite and bituminous coal to liquid and gaseous hydrocarbon products.

Hydrocracking or hydropyrolysis is the thermocracking of coal in the presence of hydrogen. Reaction temperatures and pressures are moderately high, from about 1200° to 1800° F. and from 1500 to 2500 psig. When solid coal particles are heated, the volatile matter is released. The initial devolatilization appears to take place in two broad steps. In the first step moisture, carbon oxides, chemically formed water, tars and methane are released from a reactive semi-char. Upon further heating, the semi-char is dehydrogenated to a less reactive char. A large flow of gases from the particles in the initial stages prevents hydrogen from entering the coal particles and diffusing to react with coal hydrocarbons. The materials emitted during coal pyrolysis diffuse into the bulk gas phase where reactions such as tar hydrogenation can take place.

Bitumins and other polynuclear aromatic materials from coal become sticky on heating which can produce the agglomeration of carbonaceous particles in process equipment. This can block or restrict passageways in and near high-temperature components such as the hydropyrolysis reactor and preheater. Also such condensed material may carbonize to form coke on the equipment walls and restrict flow in that manner. Other hydrocracking products including alkylated and hydroxylated aromatics such as xylenes, phenols, creosols and toluenes may be desired in differing proportions depending on the use to be made of the product. For example, high concentrations of benzene, xylene and toluene may be desirable for gasoline feed stock while other aromatics may be preferred for a particular chemical feed stock. Often a balanced blend of various aromatics is sought in the processing of coal and other carbonaceous materials.

PRIOR ART STATEMENT

The following publications relate to the technical field of the subject invention but do not disclose or make obvious the invention as claimed.

Duncan et al., FE-2307-2, "Research and Development of Rapid Hydrogenation for Coal Conversion to Synthetic Motor Fuels", Task 1, USDOE-IGT 1976. This report describes an experimental hydropyrolysis reactor for heating particles of carbonaceous material entrained in hydrogen gas flow to temperatures in the range of 900° to 1500° F. at pressures of about 2000 psig.

ERDA-76-86, *Coal Conversion and Utilization,* "Solvent—Refined Coal (SRC) Process", pages 2.7–2.13, USERDA 1976. The process described in this publication comprises slurrying coal particles with recycled solvent, mixing with hydrogen gas and heating to a temperature of about 800°–900° F. at about 100 atmospheres pressure to liquefy the coal. The liquids and solids are separated from the gas and the undissolved solids are separated by filtration of the slurry.

SUMMARY OF THE INVENTION

Therefore, in view of the above, it is an object of the present invention to provide a high-temperature method of hydrocracking carbonaceous material that has a tendency to agglomerate at elevated temperatures.

It is also an object to provide a high-temperature and short-residence-time method of hydrocracking carbonaceous material in which condensation of polynuclear aromatic species and formation of coke are minimized.

It is a further object to provide a high-temperature and short-residence-time method of hydrocracking carbonaceous material in which product oil can be usefully recycled for further processing.

In accordance with the present invention, particles of carbonaceous material are slurried in product liquid in the presence of hydrogen gas and preheated to a temperature of 600°–1200° F. at a sufficient pressure to maintain the liquid state. The slurry is further heated while flowing in a multiphase mixture including liquid oil, carbonaceous particles and hydrogen gas to vaporize substantially all of the liquid product oil and form a gas-solids flow. The resulting flow of gas-solids mixture is heated to above 1200° F. to decompose, hydrogenate and reduce the concentration of polynuclear aromatics in the mixture. The gas-solids mixture is quenched to condense and separate hydrocarbon oil from the remaining gases. The liquid hydrocarbon oil is fractionated to form liquid hydrocarbon products with a portion of the liquid hydrocarbon products recycled to slurry the particulate carbonaceous material.

In more specific aspects of the invention, the gas-solids mixture is heated to a temperature of 1400° to 1600° F. for a period of about 1 to 5 seconds to decrease the concentration of condensed polynuclear aromatics in favor of benzene and other desirable refractory constituents such as toluene and xylene.

DETAILED DESCRIPTION OF THE DRAWING

The present invention is illustrated in the accompanying drawing wherein the FIGURE is a flow diagram of a hydropyrolysis process for solid carbonaceous material slurried in product oil.

DETAILED DESCRIPTION OF THE PREFERRED EMBODIMENT

In the process illustrated in the FIGURE, coal or other carbonaceous material 11 is slurried 13 with a fraction of recycled product oil 15 and the mixture pumped by suitable high-pressure means 17 to a preheater 19. Prior to entering the preheater, hydrogen gas 21 under pressure is forced into the slurry to form a multiphase mixture of gas, liquid and solids. In preheater 19, this multiphase mixture 23 is heated to an elevated temperature of, for instance, 600° to 1200° F. at pressures of 1000 to 2500 psi at which the product oil mostly remains in the liquid state. Preheater 19 can be a conventional fired heater or a heat exchanger such as a shell and tube type provided with suitable process heat.

The multiphase mixture subsequently passes at the system pressure into a hydrocracking or hydropyrolysis reactor 25 in which substantially all of the liquid phase is vaporized to form a dry gas-solids flow. The flow is superheated to a temperature sufficient to decompose condensed polynuclear aromatics, heterocyclic compounds and other compounds containing sulfur or nitrogen in side chains. In some instances it also is desirable to dehydroxylate phenols and creosols. For these purposes, temperatures in excess of 1200° F. are required. The resulting flow of gas-solids mixture 27 leaving the reactor is quenched in a suitable unit 29, illustrated as using recycled product oil 16 for direct-contact coolant.

The quenched gas-oil mixture 31 passes to a gas-liquid separator 33, e.g. a cyclone separator, from which the liquid oil goes to a column 35 for fractionation. If desired, the remaining solids may be separated from the liquid oil prior to column 35 or, as illustrated, removed as char with heavy oil 37 from the bottom of the fractionation columm 35.

The fractionation column 35 separates the hydrocarbon oil feed into a number of boiling-point fractions. Columns of this type are well known in the petroleum industry and are capable of separating petroleum-base products into various boiling-point fractions as desired to accommodate various products.

A relatively high-boiling-point fraction 38 that may include a high proportion of polynuclear aromatics, phenols, creosols, and other combined aromatic liquids is recycled for slurrying with the coal and quenching the gas-solids mixture. The amount of recycle used for slurrying is typically about twice the weight of the coal or other carbonaceous feed. This recycle permits these combined aromatics to be further decomposed within the reactor to more valuable aromatics such as benzene, toluene and xylene that not only are less subject to condensation as polynuclear compounds but are also high octane blending ingredients. This will increase the yield of light oils, suitable for such as gasoline feed stock, which are removed at 39 as the lower-boiling fraction from the oil fractionation column 35.

The char and heavy oil 37 from the fractionation column bottom are sent to a conventional char gasification process 41 where they are reacted with steam and oxygen. The gasification operation is further provided with suitable units for carbon monoxide shift 43 and hydrogen purification 45. In order to provide sufficient hydrogen for the hydropyrolysis process, about one-half of the original carbonaceous material is sent to the gasifier. This permits a hydrogenation of about 5% by weight of the feed entering at 11. The hydrogen as thus produced is transferred through line 47 to be employed as makeup hydrogen for the hydrocracking process.

The gas flow from the gas-liquid separator 33 passes to a desulfurization and purification process 50 for the unreacted hydrogen gas recycled at 51. Well-known methods such as the Claus or Stretford process can be used for accomplishing the hydrogen purification. Light alkanes such as methane and ethane can be recovered at 53 by well-known low-temperature methods.

The hydropyrolysis reactor 25 can be as described in the assignee's copending patent application by Duncan et al., Ser. No. 015,257 filed Feb. 26, 1979, entitled "Reactor and Method for Hydrocracking Carbonaceous Material." An alternate device that may be suitable in bench-scale operations is disclosed in the applicant's copending application, Ser. No. 015,258 entitled "Process for Hydrocracking Carbonaceous Material to Provide Fuels or Chemical Feed Stock", filed Feb. 26, 1979. These patent applications also describe methods of quenching the gas-solid mixture 27 discharged from reactor 25. For the above purposes these two patent applications are hereby incorporated by reference.

The reactor described in the first of these two copending patent applications is a tubular reactor heated by the injection of oxygen-containing gas, e.g. air, at a plurality of points along the tube length. The injected oxygen reacts with the oxidizable fuel within the flow of solid carbonaceous material and gas passing through the reactor. The reactor temperature and the temperature profile can be controlled by the amount of oxygen-containing gas injected at the various points. Although only two points of oxygen injection are illustrated in the FIGURE, it will be understood that as many of such injections as are required can be performed.

By providing the feed to reactor 25 in a multiphase mixture of liquid, solid and gas, bitumins and other agglomerating materials within the solid carbonaceous material can be dissolved into the liquid phase to prevent agglomeration and plugging in the process piping and early portions of the reactor tube. Polynuclear and combined aromatics that may condense or form coke within the upper portion of the reactor can be dissolved or sufficiently dispersed in the liquid to permit their hydrogenation and decomposition within the hydropyrolysis reactor. This procedure diminishes the likelihood of coking within the reactor and further process components as well as limits the inclusion of coking materials within the product.

It is important that complete vaporization of the liquid material occur within the hydropyrolysis reactor to permit proper cracking and hydrogenation of the high-molecular-weight compounds. Unvaporized liquid may prevent adequate high-temperature exposure to the hydrogen gas such that good decomposition of high-molecular-weight compounds does not occur or that free radicals are not sufficiently hydrogenated to prevent recombination into large molecules.

The hydropyrolysis reactor is preferably operated such that the gas-solid flow is maintained at elevated temperatures above 1200° F. for only a short residence time of about 1–5 seconds. This minimizes the time available for desirable species such as toluene or xylene to degrade or for coking to occur. Through changes in temperature profile of this short-residence-time reaction, the relative concentrations of aromatics such as benzene, xylenes, phenols and creosols can be varied. A complete description of this control method is given in applicant's copending patent application, Ser. No. 15,528 cited and incorporated by reference above.

It will therefore be clear that the present invention provides an improved high-temperature, short-residence-time method for hydrocracking coal and other carbonaceous material. The method permits the use of caking coals that may otherwise plug the entrance to passageways of the hydropyrolysis reactor. In this method, the agglomerating bitumins and other polynuclear aromatics are dissolved in a recycled product liquid which is subsequently completely vaporized within the high-temperature portion of the reactor. This facilitates hydrogenation at the elevated temperatures during the short-residence-time hydrocracking process.

It will also be clear that although the present invention is described in terms of specific process steps and equipment, various changes can be made by one skilled in the art within the scope of the following claims.

The embodiments of the invention in which an exclusive property or privilege is claimed are defined as follows:

1. A method of hydrocracking solid carbonaceous material in the presence of hydrogen gas to produce hydrocarbon products comprising in combination:

mixing recycled liquid with feed particles of carbonaceous solids to form a slurry;

injecting hydrogen gas into a flow of said slurry to form a flow of multiphase mixture including carbonaceous particles, liquid and hydrogen gas;

heating said multiphase flow to a temperature of 600°-1200° F. to dissolve agglomerating bitumins and polynuclear aromatics into the liquid phase;

heating said flow to a temperature of 1200°-1800° F. to vaporize said liquid and form a substantially liquid-free gas-solids flow and to decompose and reduce the concentration of polynuclear aromatics within said gas-solids flow;

quenching said gas-solids flow to a temperature below 1200° F. to condence and separate liquid along with remaining carbonaceous char solids from the remaining gases;

fractionating said condensed liquid to form at least three fractions according to boiling point comprising light oil (39), relatively high boiling point liquid (38) and heavy oil (37);

withdrawing said light oil (39) as a hydrocarbon product;

recycling said relatively high boiling point liquid (38) to slurry said feed particles of carbonaceous material;

reacting said heavy oil (37) along with said remaining carbonaceous char solids with steam and oxygen at gasifier conditions to produce hydrogen gas, said char and heavy oil containing about one-half the carbonaceous material introduced in said carbonaceous feed particles; and returning said hydrogen gas to inject into said slurry flow of carbonaceous feed particles and liquid.

2. The method of claim 1 wherein said gas-solids flow mixture is heated to about 1400° to 1600° F. within said passageway.

3. The method of claim 1 wherein a portion of said fractionated liquid is recycled to quench said gas-solid mixture.

4. The method of claim 1 wherein said recycled liquid includes phenols, creosols, naphthalene and other polynuclear aromatics that are decomposed and hydrogenated at temperatures above 1200° F. within said gas-solid flow mixture to increase the concentration of benzene, toluene and xylene within the hydrocarbon product.

5. The method of claim 1 wherein said remaining gases after separating from said condensed liquid are further processed to separate and recycle hydrogen gas into contact with said slurry of recycled liquid and carbonaceous material and to separate and withdraw hydrocarbon product.

6. The method of claim 1 wherein the residence time of said gas-solid mixture above 1200° F. is about 1 to 5 seconds prior to quenching.

7. The method of claim 1 wherein said recycled liquid is about twice the weight of the solid feed carbonaceous material in the slurry.

* * * * *